US009064360B2

(12) United States Patent
Chung

(10) Patent No.: US 9,064,360 B2
(45) Date of Patent: Jun. 23, 2015

(54) COIN COUNTING DEVICE

(71) Applicant: Shang Yang Industrial Co., Ltd, Kaohsiung (TW)

(72) Inventor: Shu-Chuan Chung, Kaohsiung (TW)

(73) Assignee: SHANG YANG INDUSTRIAL CO., LTD, Kaohsiung (TW)

( * ) Notice: Subject to any disclaimer, the term of this patent is extended or adjusted under 35 U.S.C. 154(b) by 0 days.

(21) Appl. No.: 14/226,100

(22) Filed: Mar. 26, 2014

(65) Prior Publication Data

US 2015/0147948 A1 May 28, 2015

(30) Foreign Application Priority Data

Nov. 27, 2013 (TW) ..... 102143249 A

(51) Int. Cl.
*G07D 9/00* (2006.01)
*G07D 1/00* (2006.01)

(52) U.S. Cl.
CPC ... *G07D 9/00* (2013.01); *G07D 1/00* (2013.01)

(58) Field of Classification Search
CPC ..... G07D 1/00; G07D 9/00
USPC ..... 453/29, 30, 37, 43, 44, 54; 221/261
See application file for complete search history.

(56) References Cited

U.S. PATENT DOCUMENTS 5,484,334 A * 1/1996 Evdokimo ..... 453/3
2007/0207717 A1* 9/2007 Enomoto ..... 453/49

* cited by examiner

*Primary Examiner* — Mark Beauchaine
(74) *Attorney, Agent, or Firm* — Muncy, Geissler, Olds & Lowe, P.C.

(57) ABSTRACT

A coin counting device includes a mounting seat, a counting unit disposed removably on the mounting seat, a guiding unit, and a track unit. The mounting seat includes a first guide passage, and two retaining groove units located respectively at two sides of a central axis of the first guide passage. The counting unit is disposed selectively within one of the retaining groove units.

6 Claims, 11 Drawing Sheets

COIN COUNTING DEVICE

CROSS-REFERENCE TO RELATED APPLICATION

This application claims priority of Taiwanese Application No. 102143249, filed on Nov. 27, 2013.

BACKGROUND OF THE INVENTION

1. Field of the Invention

This invention relates to a counting device, and more particularly to a coin counting device.

2. Description of the Related Art

Referring to FIG. 1, an output construction of a coin counting machine disclosed in Taiwanese Publication No. M271212 includes two lateral plates 11, a plate block 12 disposed between the lateral plates 11, a side plate 13 disposed between the lateral plates 11 and spaced apart from the plate block 12, a coin discharging passage 14 defined among the lateral plates 11, the plate block. 12, and the side plate 13, a slot unit 15 formed through the lateral plates 11 and in spatial communication with the coin discharging passage 14, and a counting unit 16 disposed on one of the lateral plates 11.

With further reference to FIG. 2, the counting unit 16 includes a counter 161 disposed on the lateral plates 11, a contact member 162 disposed pivotally on the one of the lateral plates 11, a bearing 163 disposed on a right end of the contact member 162 and extending into the slot 15, and a torsion spring 164 for biasing the contact member 162.

When a coin 100 is moved in the coin discharging passage 14 to contact the bearing 163, as shown in FIG. 1, the bearing 163 is pushed to move upwardly in a direction 17 (see FIG. 1) to thereby move a left end of the contact member 152 away from the counter 161. Upon discharge of the coin 100 from the coin discharging passage 14, the left end of the contact member 152 is biased by the torsion spring 164 to move into contact with the counter 161, as shown in FIG. 1, for counting the number of the discharged coins 100.

The aforesaid output construction 1 of the coin counting machine suffers from the following disadvantages:

1. Narrow applicable range: Since the slot 15 is disposed at the right side of the output construction 1, the coins 100 can drop from only the right side of the output construction 1. If the coins 100 need to drop from the left side of the output construction 1, an additional output construction having a slot 15 at the left. side thereof will be required. As such, the applicable range of the output construction 1 is reduced.
2. Difficult adjustment: Since rotation of the contact member 162 is driven by the torsion spring 164, when the size of the coins 100 is changed, it is necessary to replace the torsion spring 164 with a new one having a different elastic modulus, thereby resulting in inconvenience during adjustment.
3. Low counting accuracy: since the contact member 162 is driven by the torsion spring 164 to rotate relative to the counter 161 between a contact position and a non-contact position, when the torsion spring 164 is fatigued, the counting accuracy of the counter 161 reduces gradually.

SUMMARY OF THE INVENTION

The object of this invention is to provide a coin counting device that has the advantages of wide applicable range, easy adjustment, and high counting accuracy.

According to this invention, there is provided a coin counting device comprising:

a mounting seat including an upright first base plate, an upright second base plate spaced apart from the first base plate along a front-to-rear direction, a left retaining groove unit including two left retaining grooves formed respectively through the first and second base plates and aligned with each other along the front-to-rear direction, a right retaining groove unit including two right retaining grooves formed respectively through the first and second base plates and aligned with each other along the front-to-rear direction, two first position-limiting plates disposed between the first and second base plates and spaced apart from each other, and a first guide passage defined between the first and second base plates and between the first position-limiting plates and having a central axis, the left and right retaining groove units being located respectively at two sides of the central axis;

a counting unit disposed removably and selectively within one of the left and right retaining groove units;

a track unit connected to an end of the mounting seat distal from the counting unit and defining a second guide passage in spatial communication with the first guide passage, so that coins are fed into the second guide passage, and are moved toward the counting unit through the first guide passage; and a guiding unit including a positioning plate disposed removably on the first base plate and having a plurality of retaining plate portions, a slide slot, unit including three slide slots formed respectively through the positioning plate and the first and second base plate, a swing arm disposed pivotally on the positioning plate, a rotating member disposed pivotally on the swing arm and disposed in the slide slot unit, a resilient member having two ends connected respectively to the swing arm and a selected one of the retaining plate portions, a plurality of fasteners extending through the first base plate, and a guiding spring plate disposed removably on one of the fasteners and disposed between the first and second base plates, the guiding spring plate extending from the one of the fasteners toward the counting unit and abutting against the rotating member so as to bias the coins toward the counting unit.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
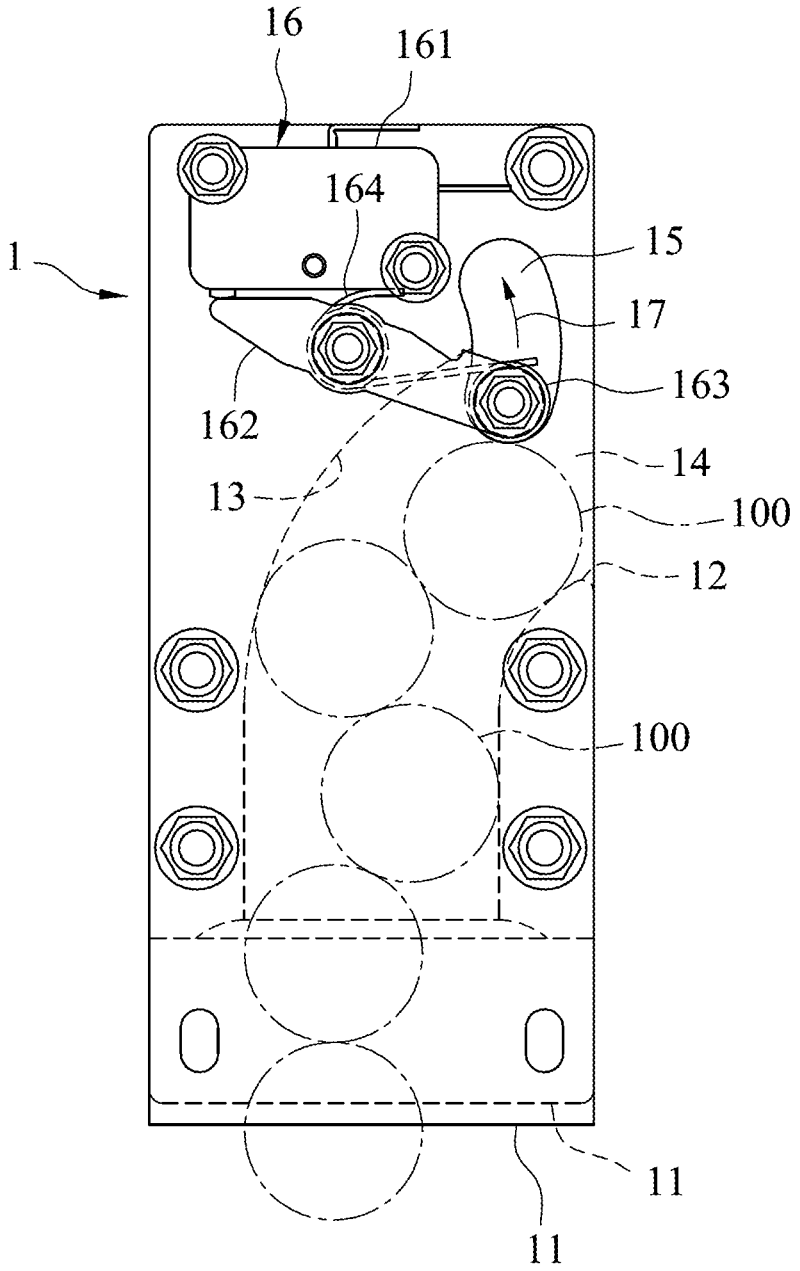
FIG.1 PRIOR ART
FIG. 1 is a side view of an output construction of a coin counting machine disclosed in Taiwanese Publication No. M271212.
Figure 2:
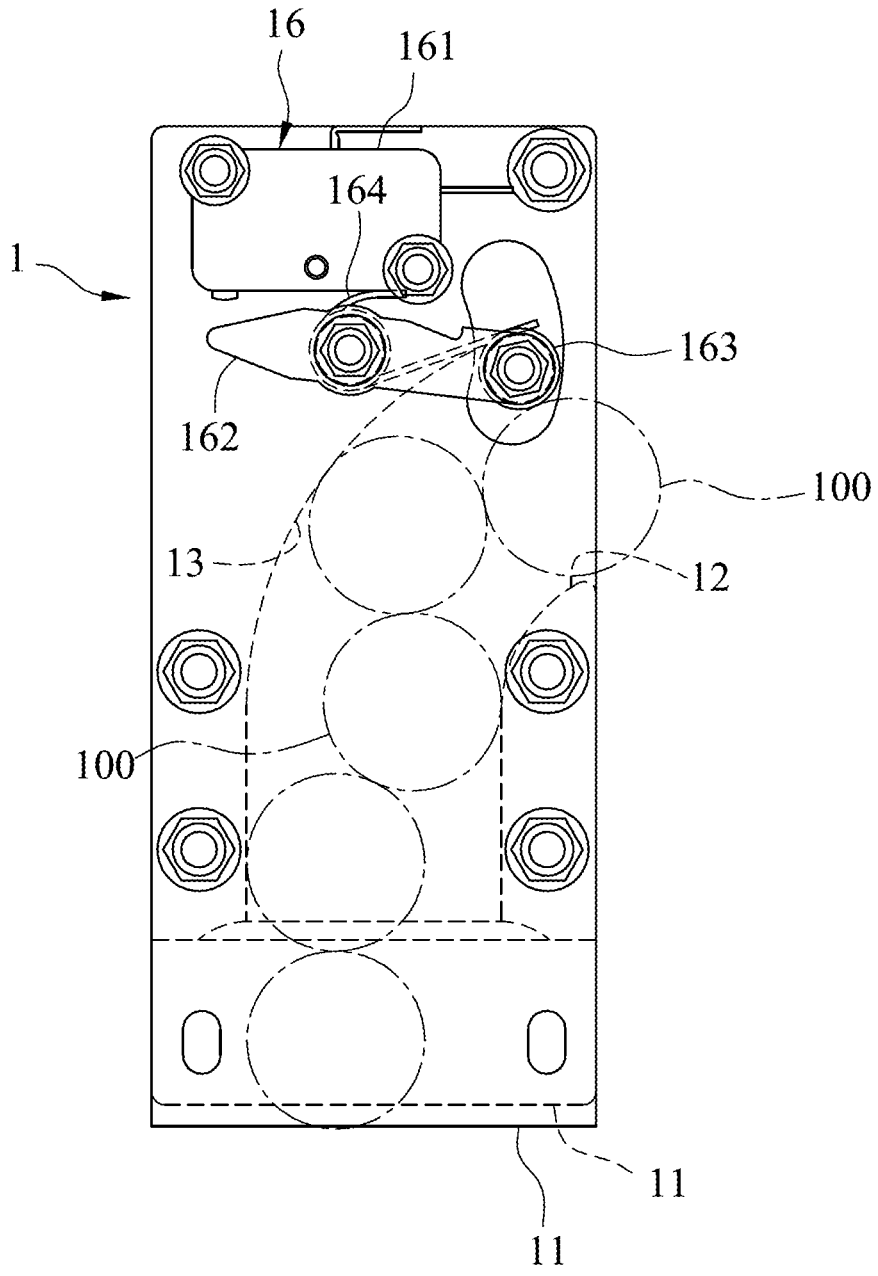
FIG.2 PRIOR ART
FIG. 2 is a view similar to FIG. 1 but illustrating how the number of coins is counted.
Figure 3:
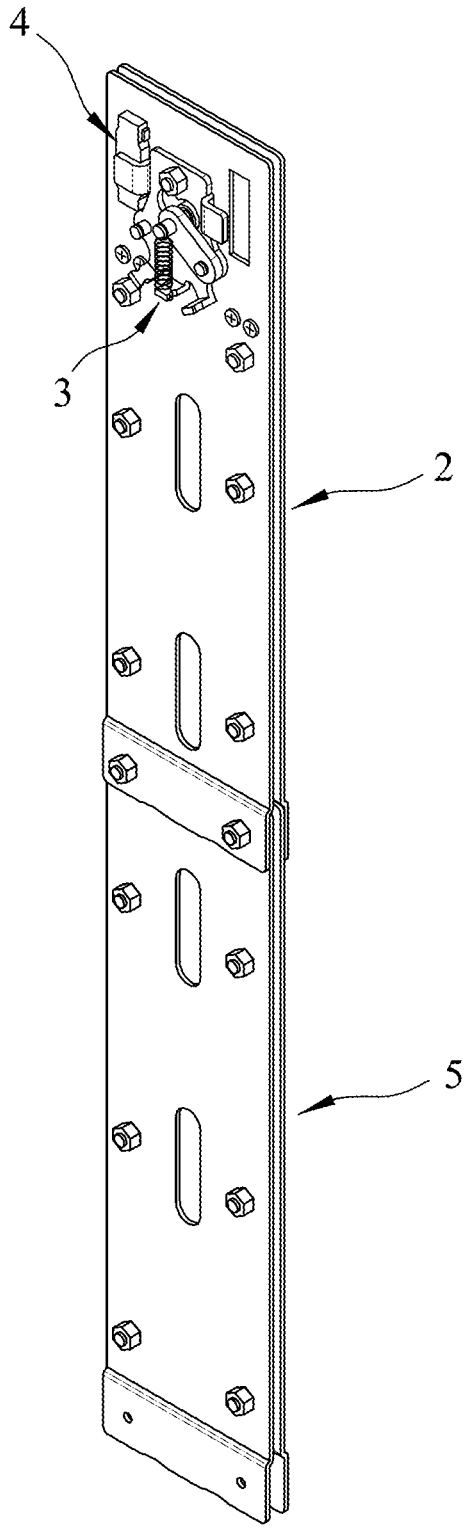
FIG. 3 is a perspective view of the preferred embodiment of a coin counting device according to this invention.

Referring to FIG. 3, the preferred embodiment of a coin counting device according to this invention is mounted in a coin counting machine (not shown), and includes a mounting seat 2, a guiding unit 3 disposed removably on the mounting seat 2, a counting unit 4 disposed removably on the mounting seat 2, and a track unit 5 disposed at an end of the mounting seat 2 distal from the counting unit 4 and connected removably between the mounting seat 2 and the coin counting machine. It should be noted that, the number of the track unit 5 may be increased.

Figure 4:
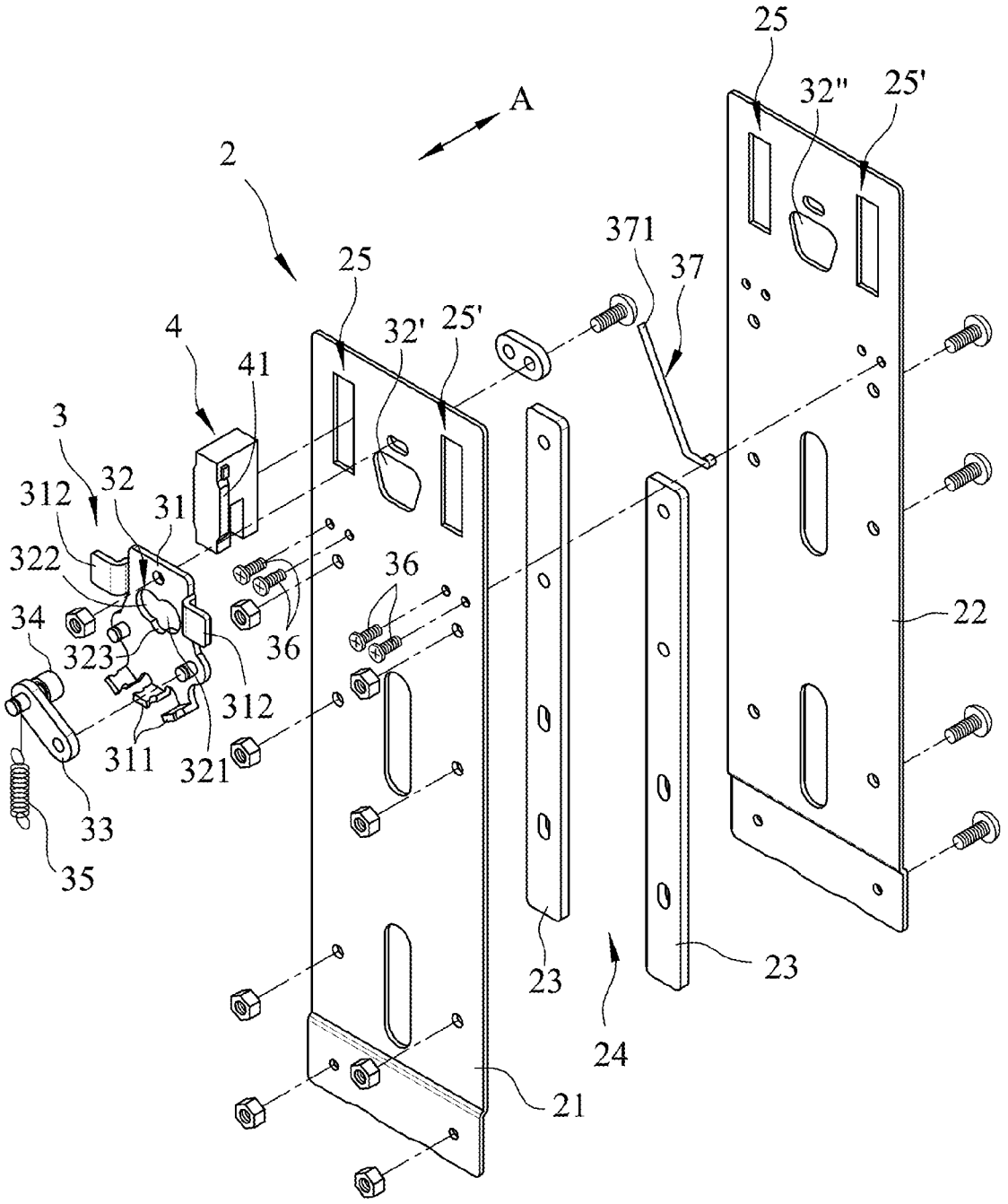
FIG. 4 is a fragmentary exploded perspective view of the preferred embodiment, illustrating a mounting seat, a guiding unit, and a counting unit.
Figure 5:
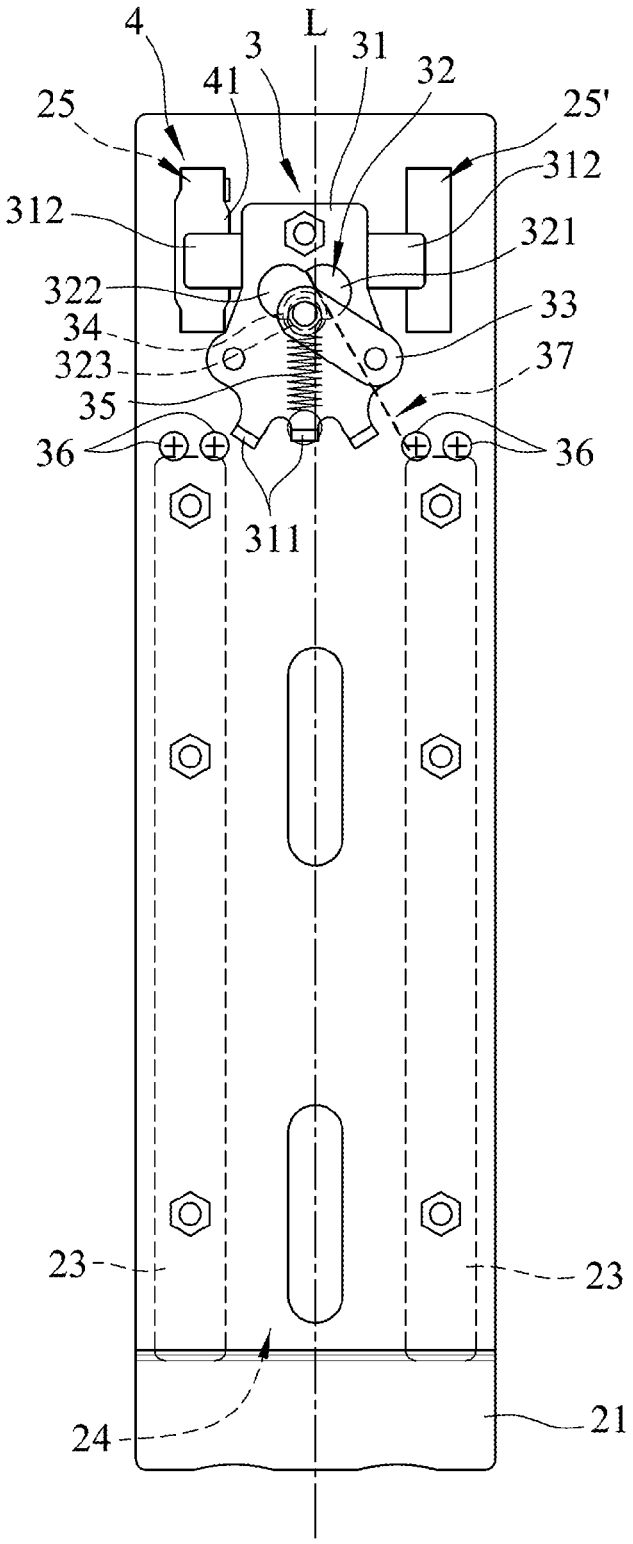
FIG. 5 is a front view of the preferred embodiment.

With further reference to FIGS. 4 and 5, the mounting seat 2 includes an upright first base plate 21, an upright second base plate 22 spaced apart from the first base plate 21 along a front-to-rear direction (A), two first position-limiting plates 23 clamped between the first and second base plates 21, 22 and spaced apart from each other, a first guide passage 24 defined between the first and second base plates 21, 22 and between the first position-limiting plates 23, a left retaining groove unit including two left retaining grooves 25 formed respectively through the first and second base plates 21, 22 and aligned with each other along the front-to-rear direction (A), and a right retaining groove unit including two right retaining grooves 25' formed respectively through the first and second base plates 21, 22 and aligned with each other along the front-to-rear direction (A). The first guide passage 24 has a central axis (L). The left and right retaining groove units are located respectively at two sides of the central axis (L). The counting unit 4 is disposed removably and selectively within one of the left and right retaining groove units.

The guiding unit 3 includes a positioning plate 31 disposed removably on the first base plate 21 and having a plurality of retaining plate portions 311, a slide slot unit including three slide slots 32, 32', 32" formed respectively through the positioning plate 31 and the first and second base plates 21, 22, a swing arm 33 disposed pivotally on the positioning plate 31, a rotating member 34 disposed pivotally on the swing arm 33 and disposed in the slide slot unit, a resilient member 35 having two ends connected respectively to the swing arm 33 and a selected one of the retaining plate portions 311, a plurality of fasteners 36 extending through the first base plate 21, and a guiding spring plate 37 disposed removably on one of the fasteners 36 and disposed between the first and second base plates 21, 22. The guiding spring plate 37 extends from the one of the fasteners 36 toward the counting unit 4, and abuts against the rotating member 34 so as to bias coins 6 toward the counting unit 4. In this embodiment, the resilient member 35 is configured as a tension spring. The slide slot 32 in the positioning plate 31 has a first slideway section 321 and a second slideway section 322 that are located respectively at two sides of the central axis (L), and a middle section 323 connected between the first and second slideway sections 321, 322 and aligned with the central axis (L) along the front-to-rear direction (A). Each of the first and second slideway sections 321, 322 extends from the middle section 323 toward a corresponding one of the left and right retaining groove units.

Figure 6:
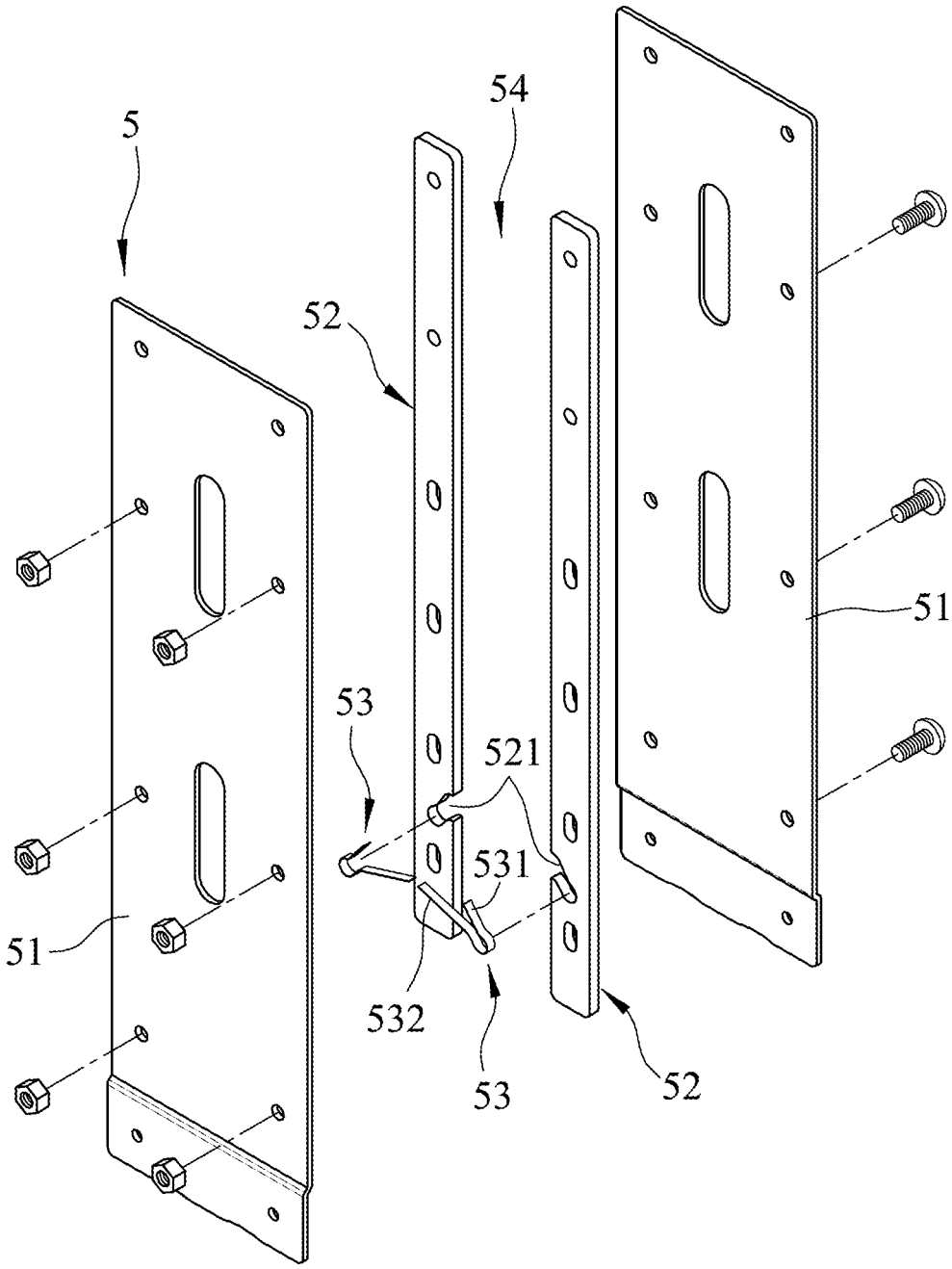
FIG. 6 is an exploded perspective view of a track unit of the preferred embodiment.
Figure 7:
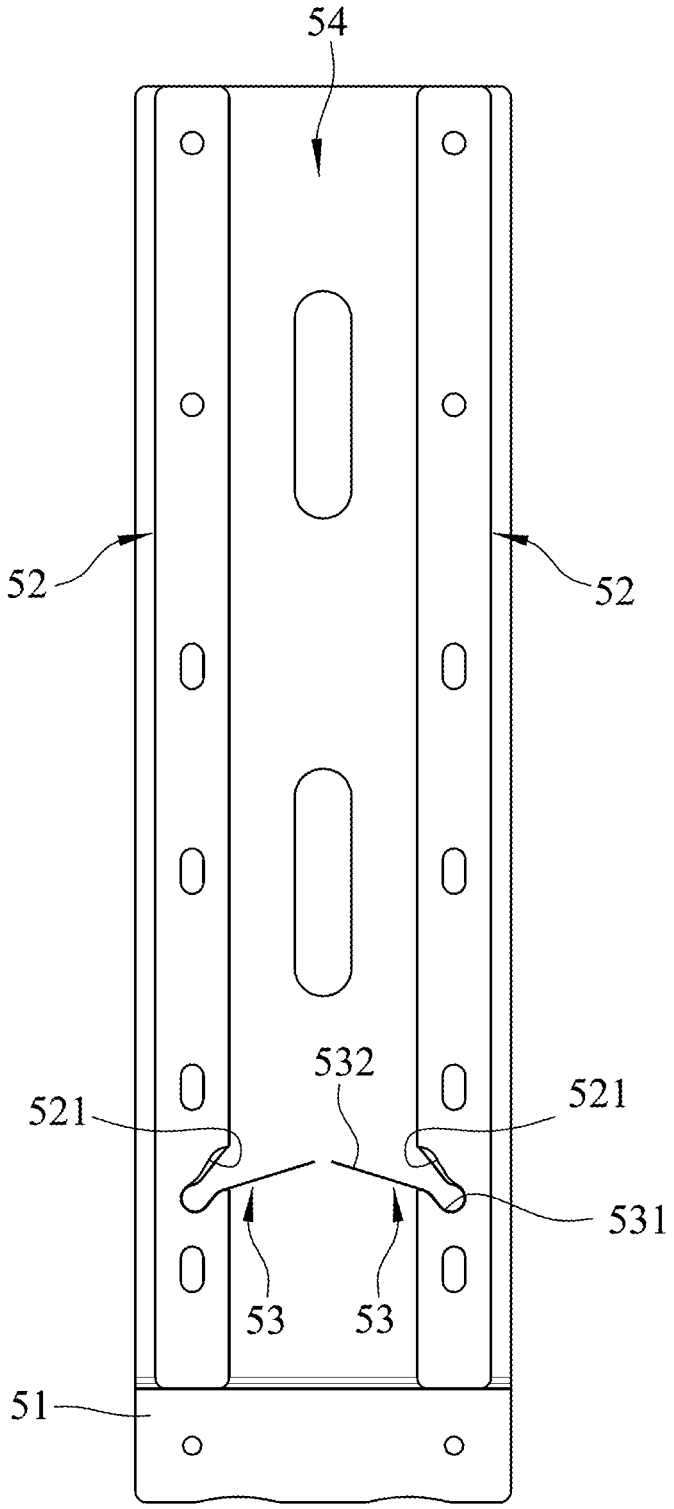
FIG. 7 is a side view of the track unit, of the preferred embodiment.

With further reference to FIGS. 6 and 7, the track unit 5 includes two spaced-apart third base plates 51, two second position-limiting plates 52 clamped between the two third base plates 51 and spaced apart from each other, and two stop members 53 disposed respectively on the two second position-limiting plates 52. The two third base plates 51 cooperate with the two second position-limiting plates 52 to define a second guide passage 54 in spatial communication with the first guide passage 24, so that coins 6 are fed into the second guide passage 54, and are moved toward the counting unit 4 through the first guide passage 24.

Each second position-limiting plate 52 has a limiting groove 521. Each stop member 53 has an engaging portion 531 disposed removably within the corresponding limiting groove 521, and a free end 532 disposed in the second guide passage 54. The two stop members 53 are spaced apart from each other, and are positioned so as to allow the coin 6 to push the free ends 532 of the stop members 53 away from each other, as shown in FIG. 8, to thereby move through a space between the free ends 532 of the stop members 53 in a direction toward the counting unit 4, while preventing the coin 6 to move through the space between the free ends 532 of the stop members 53 in a direction away from the counting unit 4.

The counting unit 4 has a protrusion 41 abutting against the first base plate 21. The positioning plate 31 of the guiding unit 3 further two limiting portions 312 corresponding respectively to the left and right retaining groove units, such that the protrusion 41 is clamped between the first base plate 21 and the corresponding limiting portion 312. In this embodiment, the counter unit 4 may be a photoelectric counter.

Figure 8:
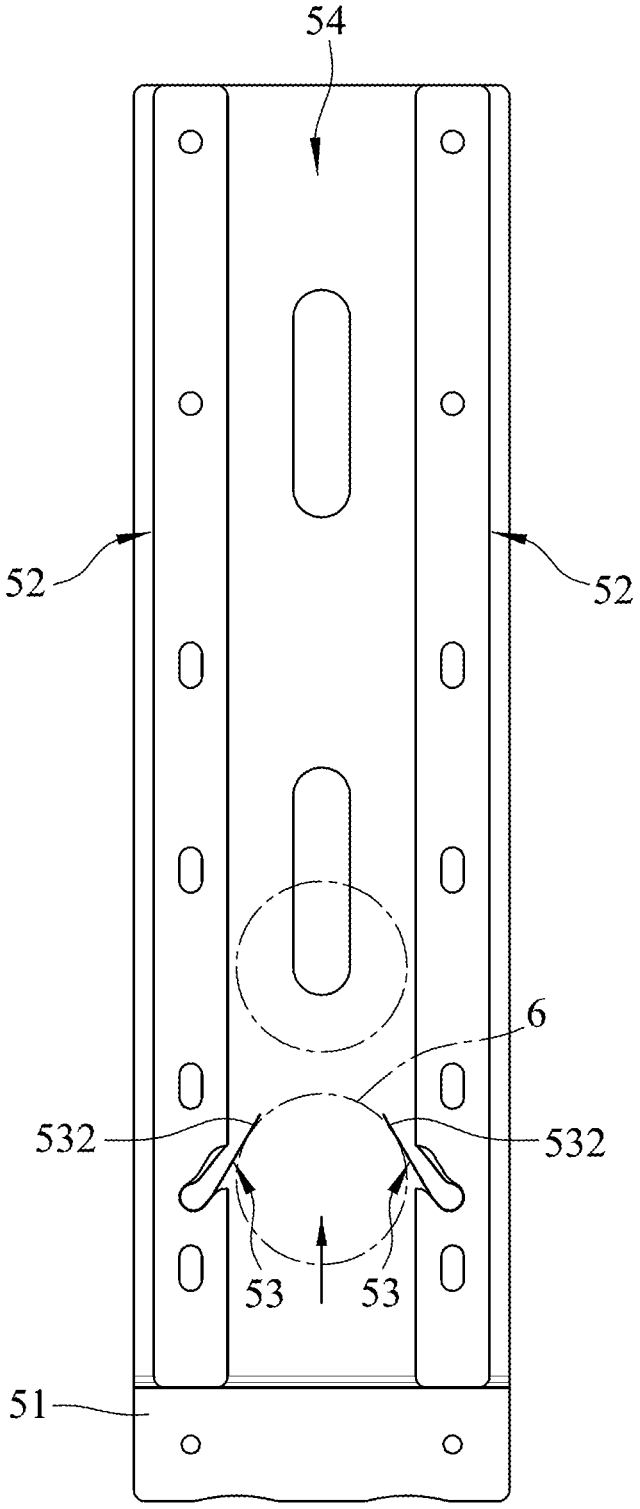
FIG. 8 is a view similar to FIG. 7 but illustrating that free ends of two stop members are pushed away from each other by a coin.

With particular reference to FIGS. 3 and 8, when a coin 6 is moved from the coin counting machine into the second guide passage 54 in the track unit 5, it pushes the free ends 532 of the stop members 53 away from each other, and is moved toward the counting unit 4.

Figure 9:
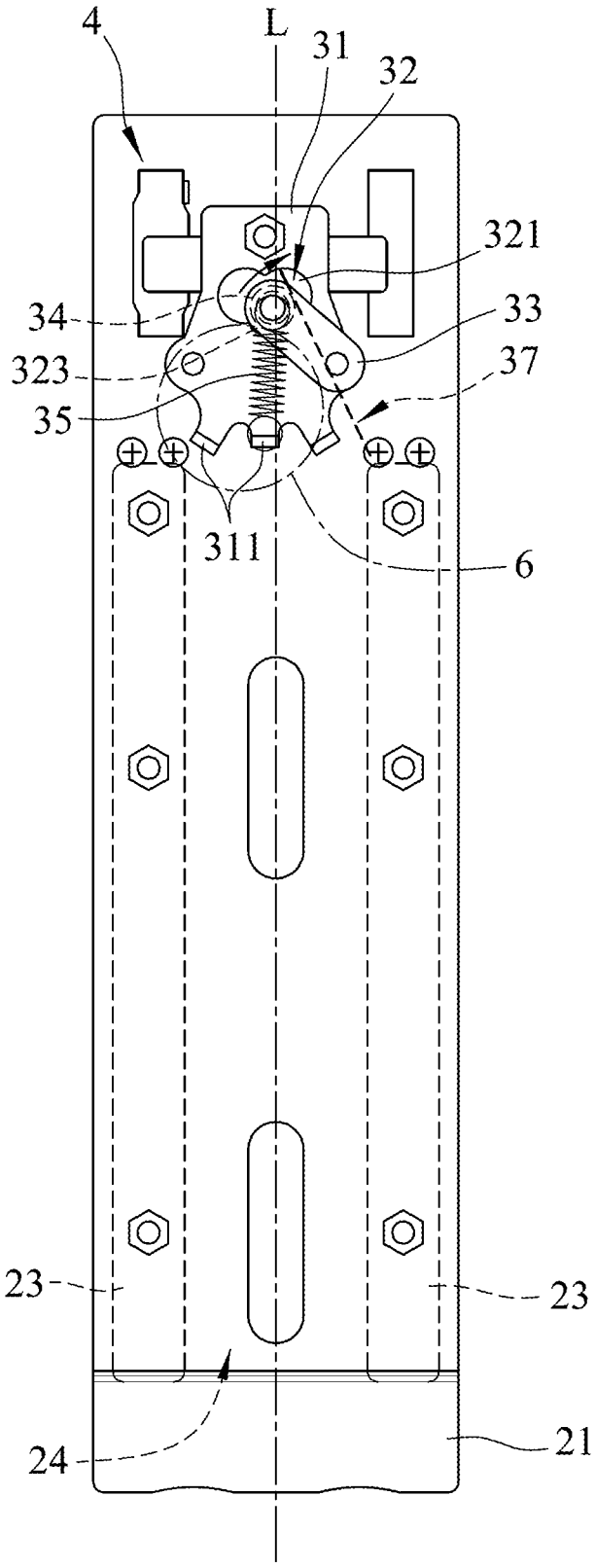
FIG. 9 is a view similar to FIG. 5 but illustrating that a swing arm is pushed by a coin to rotate.
Figure 10:
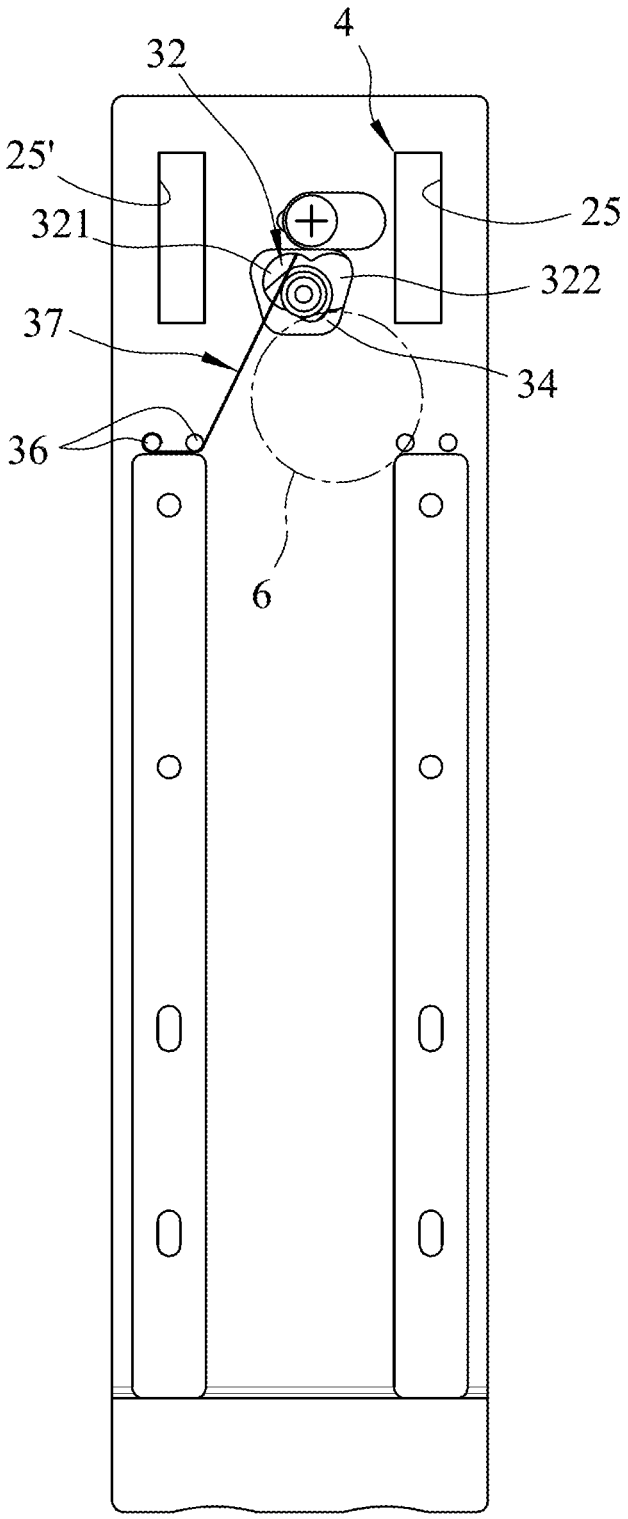
FIG. 10 is a rear view of the preferred embodiment, illustrating that a coin is guided by a guiding spring plate to drop from a side of the coin counting device.
Figure 11:
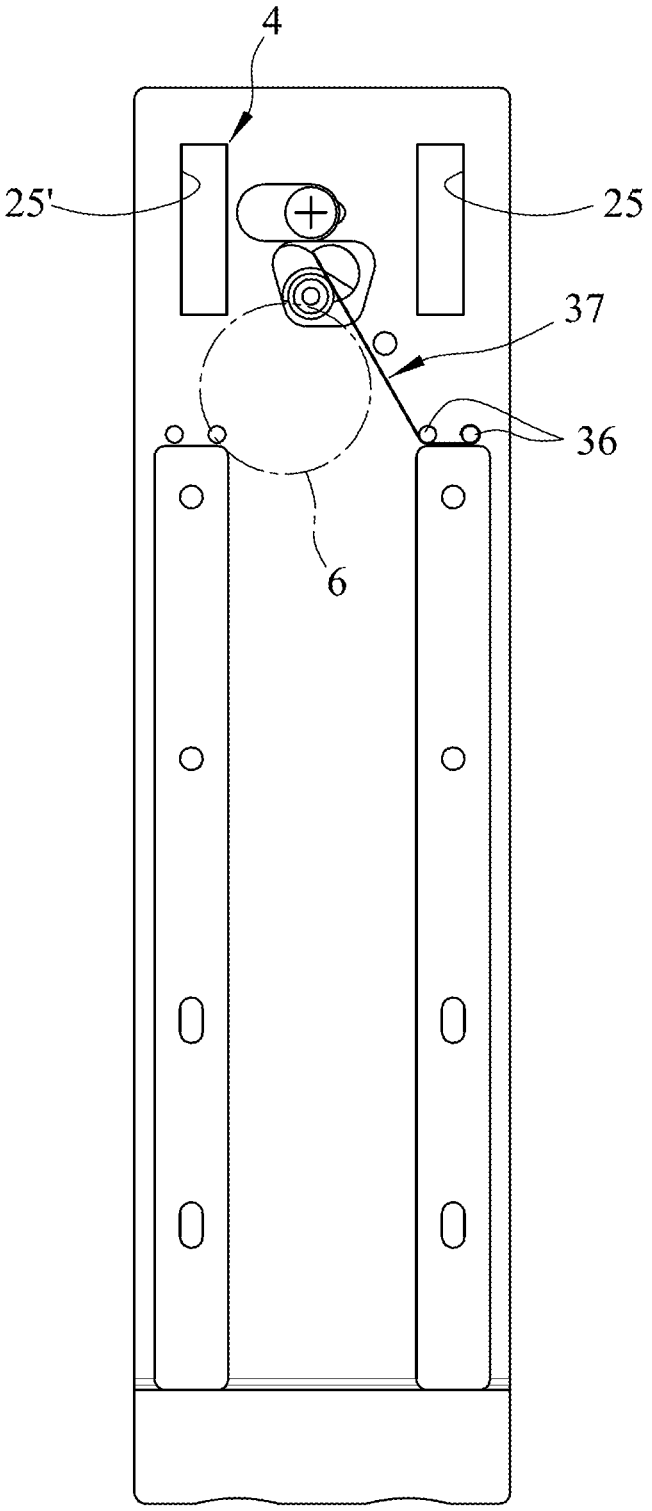
FIG. 11 is a view similar to FIG. 10 but illustrating that the positions of the guiding spring plate and a counting unit are adjusted to allow the coin to drop from an opposite side of the coin counting device.

With particular reference to FIGS. 9 and 10, when the coin 6 enters into the first guide passage 24, it is guided by the first position-limiting plates 23 to continue to move toward the counting unit 4. At the same time, the coin 6 contacts and bushes the rotating member 34 to move from the middle section 323 into the first slideway section 321 to thereby rotate the swing arm 33 clockwise so as to store a return force for biasing the rotating member 34 from the first slideway section 321 into the middle section 323. When the rotating member 34 returns from the first slideway section 321 into the middle section 323, it pushes the coin 6 to pass past the counting unit 4 under guide of the guiding spring plate 37 to subsequently drop from the left side of the coin counting device, such that the guiding spring plate 37 can prevent rightward movement of the coin 6.

Since the counting unit 4 is a photoelectric counter, the number of the coins 6 can he counted accurately. Furthermore, when the size of the coins 6 is changed, it is only necessary to move the resilient member 35 from the selected retaining plate portion 311 onto a desired one of the retaining plate portions 311, thereby resulting in convenience during use.

When it is desired to drop the coins 6 from the right side of the coin counting device, the guiding spring plate 37 is moved from the fasteners 36 disposed at the right side of the coin counting device onto the fasteners 36 disposed at the left side of the coin counting device, and the counting unit 4 is moved from the left retaining grooves 25 into the right retaining grooves 25'. As such, the applicable range of the coin counting device can be increased.

To sum up, the coin counting device of this invention has the following advantages:

1. Convenient adjustment and wide applicable range: Since the counting unit 4 is disposed removably in a selected one of the left and right retaining groove units, and since the rotating member 34 is movable among the first slideway section 321, the second slideway section 322, and the middle section 323 of the slide slot 32, the coin counting device can be adjusted to allow the coins 6 to drop from a selected one of the left and right sides of the coin counting device. Furthermore, since the relative position between the resilient member 35 and the retaining plate portions 311 is adjustable to change the spring force of the resilient member 35, the coin counting device can be used to count the coins 6 having a different size, or the discharging speed of the coins 6 can be adjusted.

2. Accurate counting: Since the counting unit 4 is a photoelectric counter, as long as the coins 6 pass past, they can be counted accurately.

With this invention thus explained, it is apparent that numerous modifications and variations can be made without departing from the scope and spirit of this invention. It is therefore intended that this invention be limited only as indicated by the appended claims.

I claim:

1. A coin counting device comprising:

a mounting seat including an upright first base plate, an upright second base plate spaced apart from said first base plate along a front-to-rear direction, two first position-limiting plates clamped between said first and second base plates and spaced apart from each other, a first guide passage defined between said first and second base plates and between said first position-limiting plates and having a central axis, a left retaining groove unit including two left retaining grooves formed respectively through said first and second base plates and aligned with each other along said front-to-rear direction, and a right retaining groove unit including two right retaining grooves formed respectively through said first and second base plates and aligned with each other along said front-to-rear direction, said left and right retaining groove units being located respectively at two sides of said central axis;

a counting unit disposed removably and selectively within one of said left and right retaining groove units;

a track unit connected to an end of said mounting seat distal from said counting unit and defining a second guide passage in spatial communication with said first guide passage, so that coins are fed into said second guide passage, and are moved toward said counting unit through said first guide passage; and a guiding unit including a positioning plate disposed removably on said first base plate and having a plurality of retaining plate portions, a slide slot unit including three slide slots formed respectively through said positioning plate and said first and second base plates, a swing arm disposed pivotally on said positioning plate, a rotating member disposed pivotally on said swing arm and disposed in said slide slot unit, a resilient member having two ends connected respectively to said swing arm and a selected one of said retaining plate portions, a plurality of fasteners extending through said first base plate, and a guiding spring plate disposed removably on one of said fasteners and disposed between said first and second base plates, said guiding spring plate extending from said one of said fasteners toward said counting unit and abutting against said rotating member so as to bias the coins toward said counting unit.

2. The coin counting device as claimed in claim 1, wherein said resilient member is configured as a tension spring.

3. The coin counting device as claimed in claim 1, wherein said counting unit has protrusion abutting against said first base plate, said positioning plate of said guiding unit further having two limiting portions corresponding respectively to said left and right retaining groove units, such that said protrusion is clamped between said first base plate and a corresponding one of said limiting portions.

4. The coin counting device as claimed in claim 3, wherein said track unit includes two spaced-apart third base plates, two second position-limiting plates clamped between said two third base plates and spaced apart from each other, and two stop members disposed respectively on said two second position-limiting plates, said second guide passage being defined among said two third base plates and said two second position-limiting plates, each of said stop members having a free end disposed in said second guide passage, said two stop members being spaced apart from each other and positioned so as to allow the coins to push said free ends of said stop members away from each other to thereby move through a space between said free ends of said stop members in a direction toward said counting unit, while preventing the coins to move through said space between said free ends of said stop members in a direction away from said counting unit.

5. The coin counting device as claimed in claim 4, wherein each of said second position-limiting plates further has a limiting groove, each of said stop members further having an engaging portion disposed removably within said limiting groove in a corresponding one of said second position-limiting plates.

6. The coin counting device as claimed in claim 5, wherein said slide slot unit has first and second slideway sections that are located respectively at two sides of said central axis, and a middle section connected between said first and second slideway sections and aligned with said central axis along said front-to-rear direction, each of said first and second slideway sections extending from said middle section toward a corresponding one of said left and right retaining groove units, said rotating member being biased into said middle section and being adapted to be pushable by one of the coins to move from said middle section into a corresponding one of said first and second slideway sections so that said resilient member provides a return force for biasing said rotating member to return to said middle section.

* * * * *